US009874219B2

(12) United States Patent
Saito

(10) Patent No.: US 9,874,219 B2
(45) Date of Patent: Jan. 23, 2018

(54) IMPELLER AND FLUID MACHINE

(71) Applicants: MITSUBISHI HEAVY INDUSTRIES, LTD., Tokyo (JP); MITSUBISHI HEAVY INDUSTRIES COMPRESSOR CORPORATION, Tokyo (JP)

(72) Inventor: Ryosuke Saito, Tokyo (JP)

(73) Assignees: MITSUBISHI HEAVY INDUSTRIES, LTD., Tokyo (JP); MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 266 days.

(21) Appl. No.: 14/787,681

(22) PCT Filed: Jun. 13, 2013

(86) PCT No.: PCT/JP2013/066388

§ 371 (c)(1),
(2) Date: Oct. 28, 2015

(87) PCT Pub. No.: WO2014/199498

PCT Pub. Date: Dec. 18, 2014

(65) Prior Publication Data

US 2016/0076551 A1 Mar. 17, 2016

(51) Int. Cl.
*F04D 29/30* (2006.01)
*F04D 29/22* (2006.01)
(Continued)

(52) U.S. Cl.
CPC ..... *F04D 29/2216* (2013.01); *F04D 1/00* (2013.01); *F04D 17/10* (2013.01); *F04D 29/242* (2013.01);
(Continued)

(58) Field of Classification Search
CPC ..... F04D 29/2216; F04D 1/00; F04D 17/10; F04D 17/08; F04D 29/681; F04D 29/68;
(Continued)

(56) References Cited

U.S. PATENT DOCUMENTS

2012/0055656 A1 3/2012 Han et al.
2013/0251533 A1* 9/2013 Hall ..... F04D 25/024 416/223 R
2015/0159670 A1* 6/2015 Saito ..... F04D 29/30 415/206

FOREIGN PATENT DOCUMENTS

CN 2274699 Y 2/1998
CN 1712733 A 12/2005
(Continued)

OTHER PUBLICATIONS

International Search Report, issued in PCT/JP2013/066388, dated Sep. 10, 2013.
(Continued)

*Primary Examiner* — Christopher Verdier
(74) *Attorney, Agent, or Firm* — Birch, Stewart, Kolasch & Birch, LLP

(57) ABSTRACT

Provided is an impeller and a fluid machine which have an annular hub (21) and a plurality of blades (22) radially arranged along an outer peripheral surface of the hub (21). On a pressure surface (P1) of the blade (22), there are provided a first pressure surface (31) extending from the hub (21) side at an angle of 90 degrees or less with respect to the forward direction of the rotation direction (A), and a second pressure surface (32) extending from the first pressure surface (31) at an angle of more than 90 degrees with respect to the forward direction of the rotation direction (A). This configuration reduces a low-energy fluid stagnating on a suction surface side of the blade, achieving higher impeller efficiency.

6 Claims, 4 Drawing Sheets

(51) Int. Cl.

| | |
|---|---|
| ***F04D 29/24*** | (2006.01) |
| ***F04D 29/28*** | (2006.01) |
| ***F04D 29/68*** | (2006.01) |
| ***F04D 1/00*** | (2006.01) |
| ***F04D 17/10*** | (2006.01) |
| ***F04D 29/42*** | (2006.01) |

(52) U.S. Cl.
CPC ..... *F04D 29/245* (2013.01); *F04D 29/284* (2013.01); *F04D 29/30* (2013.01); *F04D 29/4206* (2013.01); *F04D 29/426* (2013.01); *F04D 29/681* (2013.01); *F05D 2240/304* (2013.01); *F05D 2240/305* (2013.01)

(58) Field of Classification Search
CPC ..... F04D 29/242; F04D 29/245; F04D 29/30; F04D 29/284; F04D 29/28; F04D 29/426; F04D 29/4206; F05D 2240/305; F05D 2240/304
USPC ..... 416/183, 238, 242
See application file for complete search history.

(56) References Cited

FOREIGN PATENT DOCUMENTS

| | | | |
|---|---|---|---|
| CN | 101893003 | A | 11/2010 |
| JP | 5-87092 | A | 4/1993 |
| JP | 11-22695 | A | 1/1999 |
| JP | 2002-332991 | A | 11/2002 |
| JP | 2006-2585 | A | 1/2006 |
| JP | 2009-133267 | A | 6/2009 |
| JP | 2011-226448 | A | 11/2011 |
| JP | 2013-199870 | A | 10/2013 |
| WO | WO 2009/128299 | A1 | 10/2009 |
| WO | WO 2012/090656 | A1 | 7/2012 |
| WO | WO 2012/161849 | A1 | 11/2012 |

OTHER PUBLICATIONS

Japanese Notice of Rejection, issued in JP2012-068413, dated May 25, 2015.
Written Opinion of the International Searching Authority, issued in PCT/JP2013/066388, dated Sep. 10, 2013.
Japanese Decision to Grant a Patent with English translation for Japanese Application No. 2015-148769, dated Nov. 1, 2016.
Japanese Notification of Reasons for Refusal with machine translation for Japanese Application No. 2016-020106, dated Nov. 22, 2016.
Chinese Office Action dated Aug. 23, 2016 issued in corresponding Chinese Patent Application No. 201380076211.7 with an English Translation.
Notice of Allowance dated Jan. 5, 2016 issued in corresponding Japanese Application No. 2012-068413 with an English Translation.
Extended European Search Report, dated Jan. 20, 2017, for European Application No. 13886738.7.
English translation of the Written Opinion of the International Searching Authority (Form PCT/ISA/237), dated Sep. 10, 2013, for International Application No. PCT/JP2013/066388.
Japanese Office Action dated Apr. 28, 2016 in corresponding Japanese Patent Application No. 2015-148769 with English Translation.

* cited by examiner

IMPELLER AND FLUID MACHINE

TECHNICAL FIELD

The present invention relates to an impeller which is placed in a compressor, a pump, and the like of centrifugal type or mixed-flow type, the impeller being capable of increasing pressure of a fluid. The present invention also relates to a fluid machine having the impeller.

BACKGROUND ART

Examples of the fluid machine include a centrifugal compressor which pressure feeds a fluid. The centrifugal compressor includes a casing, an impeller placed rotatably inside the casing, and a driving unit capable of rotating the impeller. By rotating the impeller by means of the driving unit, the fluid is taken inside the casing from the front side of the impeller in the direction along the impeller axis. The fluid is then pressure-fed to the outer side of the impeller in the radial direction to be discharged outward from the casing.

For example, a centrifugal-compressor impeller is described in Patent Literature 1. The centrifugal-compressor impeller described in Patent Literature 1 has a notch provided along a blade root. The notch is made between a blade and an adjacent blade located on the rear of the blade in the direction of blade rotation. With this configuration, a secondary flow having flowed along a surface of a hub to the notch flows through the notch to be drawn to the back side of the hub. As a result, a low-energy fluid stagnating on the suction surface side of the blade is reduced.

CITATION LIST

Patent Literature

Patent Literature 1: Japanese Patent Application Laid-open 2009-133267

SUMMARY OF INVENTION

Technical Problem

The aforementioned compressor impeller has a notch provided along the blade root. This reduces a low-energy fluid stagnating on the suction surface side of the blade. Recently, however, there has been a demand for a compressor having an increased compressor efficiency.

The present invention has been developed to solve the above problem. An objective of the invention is to provide an impeller and a fluid machine which are capable of increasing efficiency by reducing a low-energy fluid stagnating on the suction surface side of a blade.

Solution to Problem

According to an aspect of the present invention, an impeller includes: a hub having an annular shape; and a plurality of blades radially arranged along an outer peripheral surface of the hub, the impeller being configured in such a manner that a fluid having flowed from a leading edge side of the blade along a rotation axis is discharged from a trailing edge side of the blade outward in the radial direction intersecting the rotation axis. A pressure surface of the blade includes: a first pressure surface extending from the hub side at an angle of 90 degrees or less with respect to the forward direction of the direction of rotation of the impeller; and a second pressure surface extending from the first pressure surface at an angle of more than 90 degrees with respect to the forward direction of the direction of rotation of the impeller.

With this configuration, when the impeller rotates, the first pressure surface generates fluid flow moving along the hub surface. At this time, a low-energy fluid is prone to stagnate on a suction surface side of a blade in front. However, the second pressure surface generates fluid flow going to the suction surface side of the blade in front, which reduces the low-energy fluid stagnating on the suction surface side of the blade. As a result, impeller efficiency improves.

Advantageously, in the impeller, the pressure surface of the blade includes a third pressure surface extending from the second pressure surface at an angle of 90 degrees or less with respect to the forward direction of the direction of rotation of the impeller.

With this configuration, the third pressure surface generates fluid flow going to the suction surface side of the blade in front, which reduces the low-energy fluid stagnating on the suction surface side of the blade.

Advantageously, in the impeller, the first pressure surface and the third pressure surface are inclined forward in the rotation direction with respect to the hub.

With this configuration, the first and third pressure surfaces generate fluid flows, which act to reduce the low-energy fluid stagnating on the hub side of the suction surface side of the blade in front.

Advantageously, in the impeller the pressure surface of the blade includes the second pressure surface at least on an outer peripheral side of the blade.

The low-energy fluid which stagnates on the suction surface side of the blade in front tends to be generated on the outer peripheral side of the blade. With the second pressure surface located on the outer peripheral side of the blade, the low-energy fluid stagnating on the suction surface side of the blade is effectively reduced.

Advantageously, in the impeller, the pressure surface of the blade has a curved shape bending forward in the rotation direction on an inner peripheral side, while having an S-shape formed of the first pressure surface, the second pressure surface, and the third pressure surface on the outer peripheral side.

With the pressure surface having a curved shape on the inner peripheral side and an S-shape on the outer peripheral side, a fluid is pressure-fed efficiently.

Advantageously, in the impeller, the second pressure surface is located within one-half (½) or less the length of the blade from the hub in a direction along the rotation axis.

With this configuration, the second pressure surface is located on the hub side of the blade. This effectively reduces the low-energy fluid stagnating on the suction surface side of the blade.

Advantageously, in the impeller, the second pressure surface faces a suction surface in a distal end part of the blade located in front in the rotation direction.

With this configuration, fluid flow generated by the second pressure surface flows to the opposing suction surface in the distal end part of the blade. This effectively reduces the low-energy fluid stagnating on the suction surface side of the blade.

According to another aspect of the present invention, a fluid machine includes: a casing having a hollow shape; an impeller rotatably supported in the casing, and having a plurality of blades radially arranged along an outer peripheral surface of a hub having an annular shape; a suction passage through which a fluid flows along a direction of the axis to be drawn in the impeller from a leading edge side of the impeller; and a discharge passage through which the fluid having been pressure fed by the impeller flows to be discharged from a trailing edge side of the blade outward in the radial direction intersecting the direction of the axis of the impeller. A pressure surface of the blade includes: a first pressure surface extending from the hub side at an angle of 90 degrees or less with respect to the forward direction of the direction of rotation of the impeller; and a second pressure surface extending from the first pressure surface at an angle of more than 90 degrees with respect to the forward direction of the direction of rotation of the impeller.

With this configuration, when the impeller rotates, the fluid flows through the suction passage along the direction of the axis to be drawn in the impeller from the leading edge of the impeller. Further, the fluid having been compressed by the impeller flows through the discharge passage, to be discharged from the trailing edge side of the blade outward in the radial direction intersecting the direction of the axis of the impeller. At the same time, in the impeller, the first pressure surface generates fluid flow moving along the hub surface, when a low-energy fluid is prone to stagnate on a suction surface side of a blade in front. However, the second pressure surface generates fluid flow going to the suction surface side of the blade in front, which reduces the low-energy fluid stagnating on the suction surface side of the blade. As a result, impeller efficiency improves.

Advantageous Effect of Invention

In the impeller and the fluid machine of the present invention, the pressure surface of the blade has the first pressure surface extending from the hub side at an angle of 90 degrees or less with respect to the forward direction of the direction of impeller rotation, and the second pressure surface extending from the first pressure surface at an angle of more than 90 degrees with respect to the forward direction of the direction of impeller rotation. With the impeller and the fluid machine, therefore, the second pressure surface generates fluid flow moving to the suction surface side of the blade in front. This reduces the low-energy fluid stagnating on the suction surface side of the blade. As a result, impeller efficiency improves.

DESCRIPTION OF EMBODIMENT

An exemplary embodiment of the impeller and the fluid machine according to the present invention is described in detail below with reference to the attached drawings. It is to be understood that the present invention is not limited to the embodiment. When two or more embodiments are given herein, the invention encompasses a combination of such embodiments.

Embodiment

Figure 1:
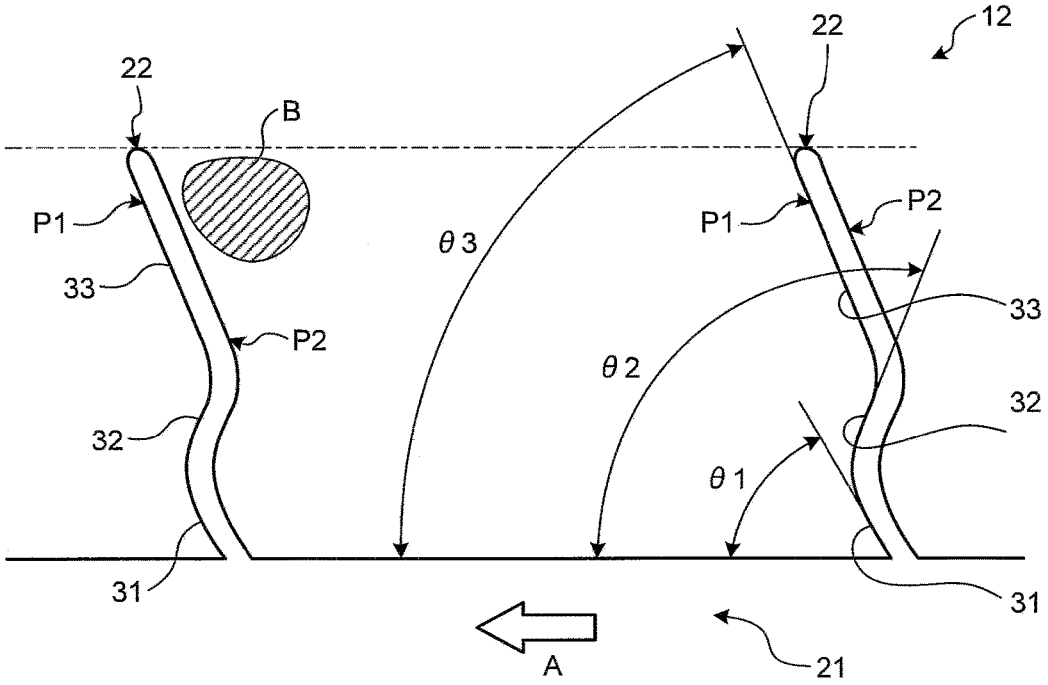
FIG. 1 is a sectional view illustrating a centrifugal-compressor impeller according to an embodiment of the present invention.
Figure 2:
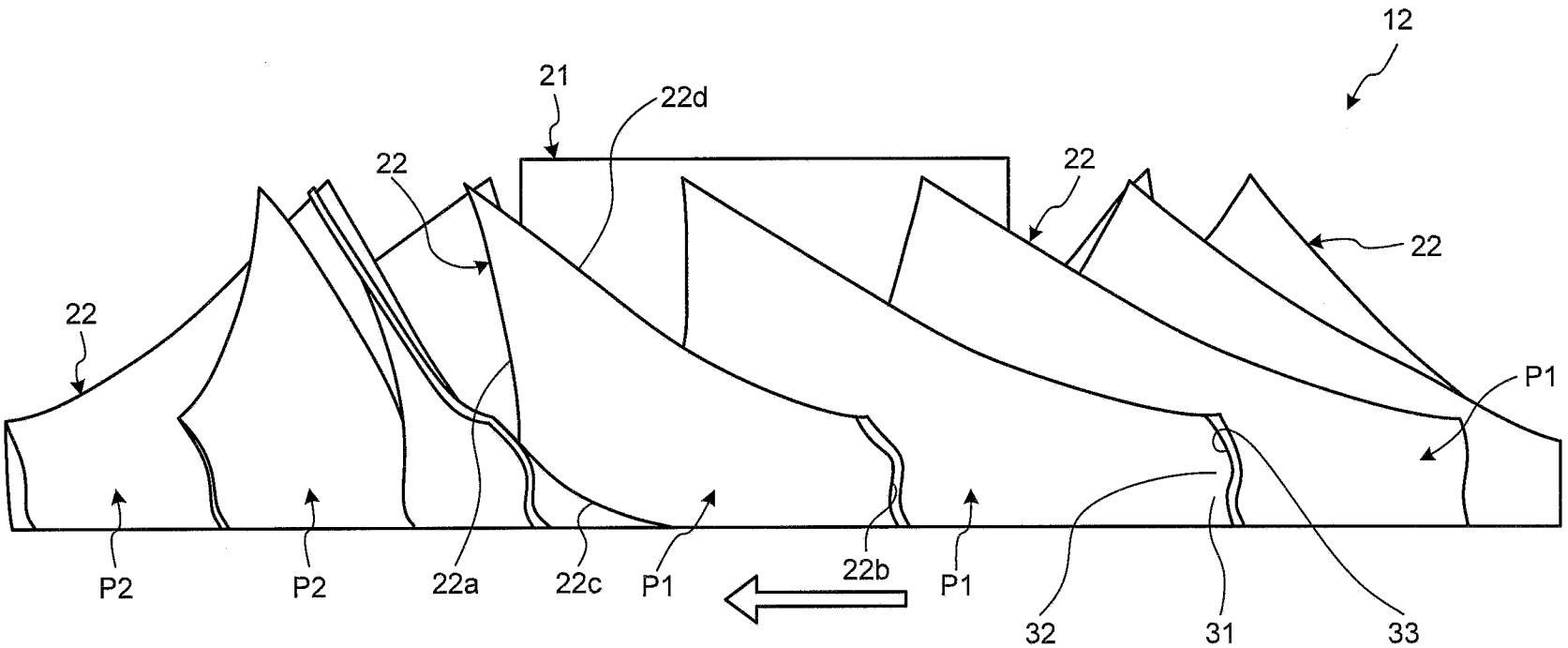
FIG. 2 is a front view illustrating the impeller according to the present embodiment.
Figure 3:
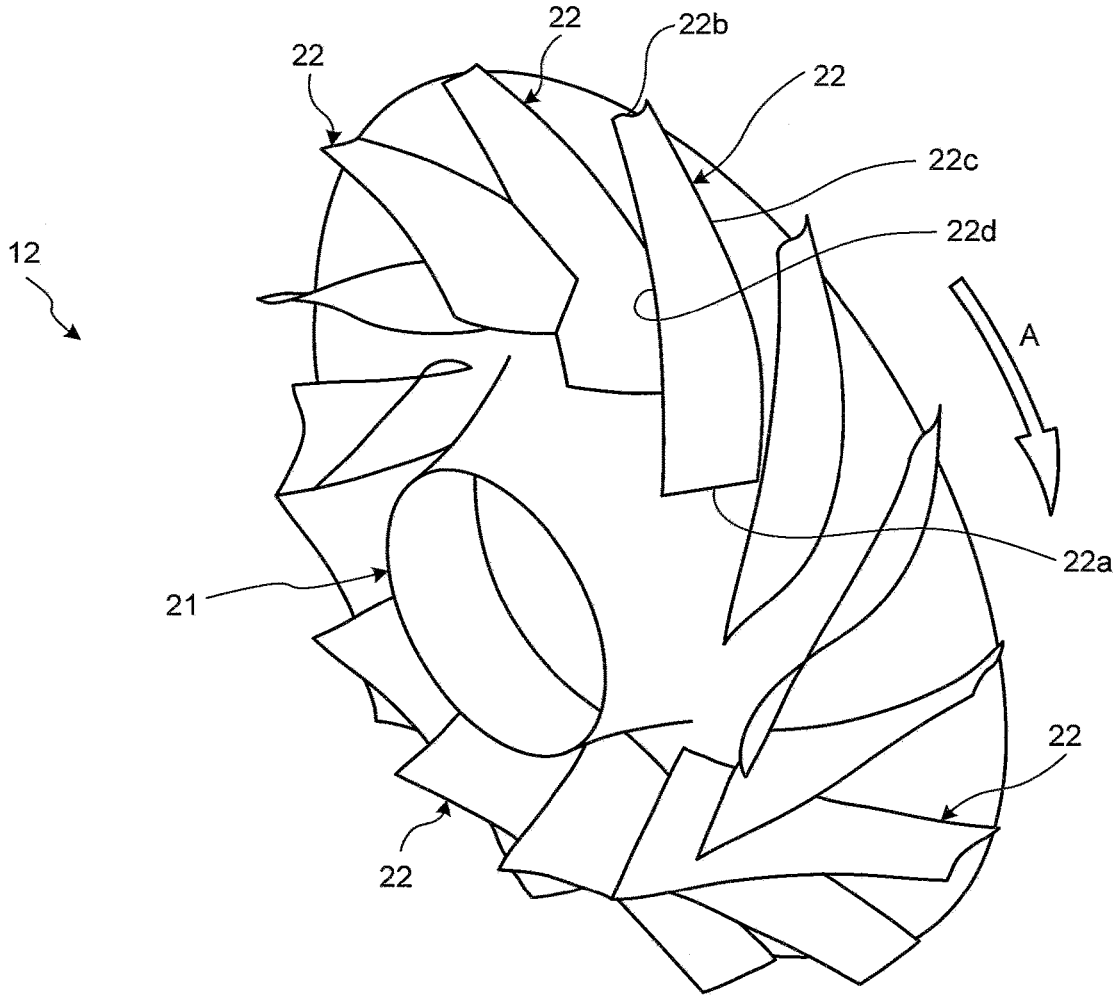
FIG. 3 is a perspective view illustrating the impeller according to the present embodiment.
Figure 4:
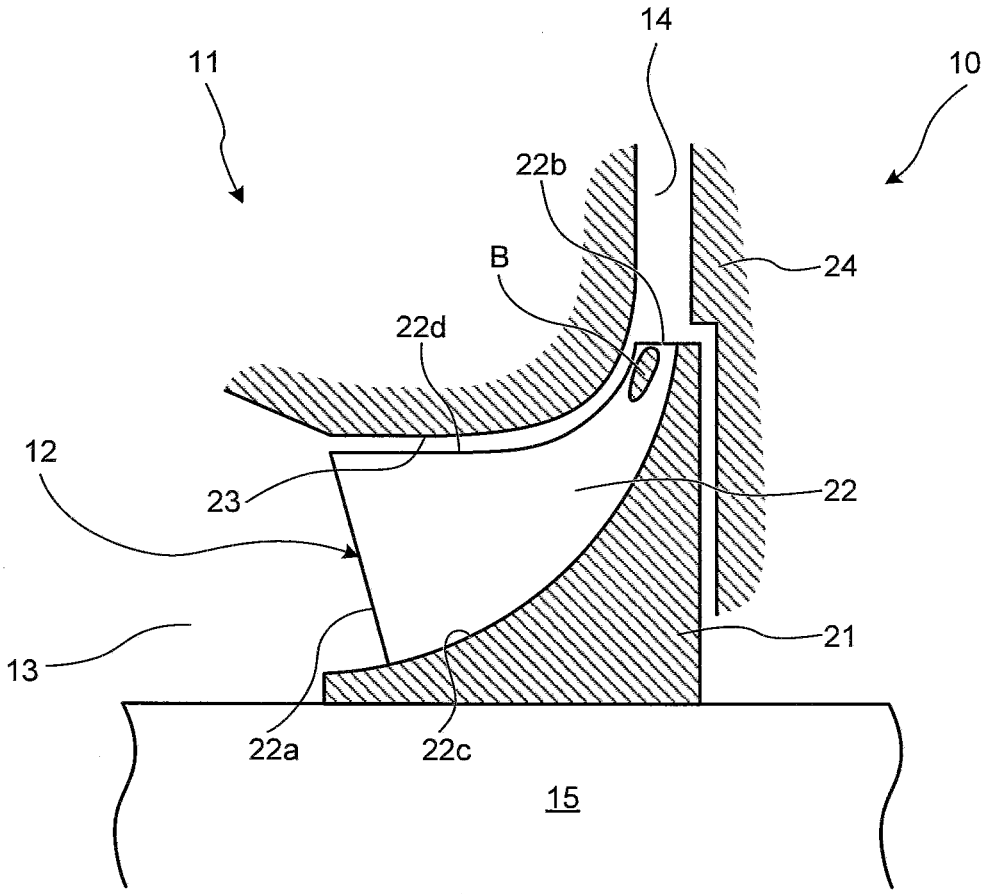
FIG. 4 is a schematic view illustrating a centrifugal compressor according to the present embodiment.

FIG. 1 is a sectional view illustrating a centrifugal-compressor impeller according to an embodiment of the present invention. FIG. 2 is a front view illustrating the impeller according to the present embodiment. FIG. 3 is a perspective view illustrating the impeller according to the present embodiment. FIG. 4 is a schematic view illustrating a centrifugal compressor according to the present embodiment.

In the present embodiment, as illustrated in FIG. 4, a centrifugal compressor 10 according to a first embodiment includes a casing 11, an impeller 12, a suction passage 13, and a discharge passage 14. The casing 11 has a hollow shape. In the center of the casing, a rotary shaft 15 is rotatably supported by a bearing which is not illustrated. A driving unit which is not illustrated is connected to an end part of the rotary shaft 15. An impeller 12 is fixed to the outer perimeter of the rotary shaft 15. The impeller 12 includes a hub 21 as an annular member, and a plurality of blades 22 radially arranged on an outer peripheral surface of the hub 21. At the same time, the hub 21 is fixed to the rotary shaft 15. The outer peripheral surface of the hub 21 has a curved shape in such a manner that the direction of the outer peripheral surface changes from a direction along the rotary shaft 15 to a direction intersecting (perpendicular to) the direction along the rotary shaft 15. Each of the blades 22 is fixed circumferentially at a predetermined interval to the outer peripheral surface curving in the direction along the rotary shaft 15. A predetermined space is secured between the impeller 12 and a shroud 23 of the casing 11.

In the casing 11, there is formed a suction passage 13 through which a fluid flows in a direction of the axis of the impeller 12 to be drawn in the impeller 12, so that the fluid can be introduced into a front part of the impeller 12 via the suction passage 13. The shroud 23 forms the suction passage 13. In the casing 11, there is also formed a discharge passage (a diffuser) 14 on the outer peripheral side of the impeller 12. The fluid having been pressure-fed by the impeller 12 is discharged through the discharge passage 14, flowing along the radial direction intersecting the direction of the axis of the impeller 12. The fluid having been compressed by the impeller 12 is expelled to the discharge passage 14. The shrouds 23, 24 of the casing 11 form the discharge passage 14.

When the rotary shaft 15 is rotated by means of the driving unit, the impeller 12 rotates, so that the fluid is drawn in to the casing 11 through the suction passage 13. The fluid, then, is increased in pressure while flowing through the rotating impeller 12. The fluid is subsequently expelled to the discharge passage 14, where the dynamic pressure of the fluid having been compressed is converted to static pressure. The fluid is then discharged from an outlet to the outside.

The impeller 12 according to the present embodiment, which is configured as above, includes the plurality of blades 22 radially fixed to the outer peripheral surface of the hub 21, as illustrated in FIGS. 1 to 3. Each of the blades 22 is identical in shape and has a pressure surface P1 on the front side and a suction surface P2 on the rear side with respect to the rotation direction indicated by an arrow A.

On the pressure surface P1 of the blade 22, there are formed: a first pressure surface 31 extending from the hub 21 side to the shroud 23 side at an angle θ1 of 90 degrees or less with respect to the forward direction of the rotation direction A; a second pressure surface 32 extending from the first pressure surface 31 to the shroud 23 side at an angle θ2 of more than 90 degrees with respect to the forward direction of the rotation direction A; and a third pressure surface 33 extending from the second pressure surface 32 to the shroud 23 side at an angle θ3 of 90 degrees or less with respect to the forward direction of the rotation direction A.

The pressure surface P1 of the blade 22 has a curved cross section on the side of the leading edge 22*a* on the inner peripheral side. Specifically, the pressure surface P1 bends forward in the rotation direction A from the base end part 22*c* on the hub 21 side to the distal end part 22*d* on the shroud 23 side, in such a manner that the blade 22 has a recess on the pressure surface P1 side. The pressure surface P1 of the blade 22 also has an S-shaped cross section on the trailing edge 22*b* on the outer peripheral side. Specifically, the pressure surface P1 has the first pressure surface 31, the second pressure surface 32, and the third pressure surface 33 formed in this order from the base end part 22*c* on the hub 21 side to the distal end part 22*d* on the shroud 23 side, so as to have an S-shaped cross section.

In this case, the shape of the pressure surface P1 of the blade 22 gradually changes, with respect to the longitudinal direction intersecting the direction of the axis of the hub 21, from the curved cross section on the leading edge 22*a* to the S-shaped cross section on the trailing edge 22*b*. Specifically, the pressure surface P1 of the blade 22 starts to change in cross section at approximately one third (⅓) the length of the blade from the leading edge 22*a*, then gradually changes into the S-shape with respect to the longitudinal direction intersecting the direction of the axis of the hub 21, in the direction from the leading edge 22*a* to the trailing edge 22*b*. In other words, on the pressure surface P1 of the blade 22, the second pressure surface 32 starts to be formed at approximately one-third (⅓) the length of the blade from the leading edge 22*a*. Then the angle θ2 increases gradually until it reaches a specified value of the angle θ2 at the trailing edge 22*b*. Based on the above, the pressure surface P1 of the blade 22 desirably has the second pressure surface 32 at least on the trailing edge 22*b*.

Further, on the pressure surface P1 of the blade 22, the first pressure surface 31 extends in the direction from the base end part 22*c* on the hub 21 side to the distal end part 22*d* on the shroud 23 side. The first pressure surface 31 is located within one-fourth (¼) or less the length of the blade 22 from the base end part 22*c* in a direction along the rotation axis. Further, on the pressure surface P1 of the blade 22, the second pressure surface 32 extends in the direction from the base end part 22*c* on the hub 21 side to the distal end part 22*d* on the shroud 23 side. The second pressure surface is located within one-half (½) or less the length of the blade 22 from the base end part 22*c* in the direction along the rotation axis.

The first pressure surface 31, the second pressure surface 32, and the third pressure surface 33 are described in detail below with reference to FIG. 1. The first pressure surface 31 extends from the hub 21 side toward the shroud 23 side at an angle θ1 of 90 degrees or less with respect to the forward direction of the rotation direction A. It is desirable that the angle θ1 be smaller than 90 degrees. The second pressure surface 32 extends from the first pressure surface 31 toward the shroud 23 side at an angle θ2 of more than 90 degrees with respect to the forward direction of the rotation direction A. It is desirable that the second pressure surface 32 face the suction surface P2 in the distal end part 22*d* of the blade 22 located in front in the rotation direction A. The third pressure surface 33 extends from the second pressure surface 32 toward the shroud 23 side at an angle θ3 of 90 degrees or less with respect to the forward direction of the rotation direction A. It is desirable that the angle θ3 be smaller than 90 degrees. In other words, it is desirable that the first pressure surface 31 and the third pressure surface 33 be slanted toward the hub 21 side. It is also desirable that the second pressure surface 32 be slanted toward the shroud 23 side.

The pressure surface P1 of the blade 22 has the first pressure surface 31, the second pressure surface 32, and the third pressure surface 33. It is desirable that each of the pressure surfaces 31, 32, 33 be a plane surface or a protruding curved surface extending from the base end part 22*c* to the distal end part 22*d*. When each of the pressure surfaces 31, 32, 33 is a protruding curved surface, each of the angles θ1, θ2, θ3 corresponding to each of the pressure surfaces 31, 32, 33 is an angle of tangent. Meanwhile, the second pressure surface 32 faces the suction surface P2 in the distal end part 22*d* of the blade 22 located in front in the rotation direction A. This means the normal to the second pressure surface 32 is in the direction toward the suction surface P2 in the distal end part 22*d* of the blade 22.

Each blade 22 entirely has a substantially uniform thickness. The blade 22 has, on one side thereof, the pressure surface P1 having the three pressure surfaces 31, 32, 33. The suction surface P2 on the rear side of the blade 22, therefore, has substantially the same shape as the pressure surface P1.

With the above configuration, a fluid flows in the impeller 12 from the leading edge 22*a* side, when the impeller 12 rotates. The fluid increases in pressure while passing through the rotating impeller 12. Then the fluid is discharged from the trailing edge 22*b* side. At the same time, in the impeller 12, the first pressure surface 31 located on the pressure surface P1 on each of the blades 22 generates fluid flow moving along the hub 21 surface, when a low-energy fluid B is prone to stagnate on the suction surface P2 side of the blade 22 in front. However, the fluid flow generated by the first pressure surface 31 acts on the hub 21 side of the suction surface P2 of the blade 22 in front. This reduces the low-energy fluid B stagnating on the hub 21 side of the suction surface P2 of the blade 22. Moreover, the fluid flow generated by the second pressure surface 32 acts on the shroud 23 side of the suction surface P2 of the blade 22 in front This reduces the low-energy fluid B stagnating on the shroud 23 side of the suction surface P2 of the blade 22.

As described previously, the impeller 12 according to the present invention includes the hub 21 having an annular shape, and the plurality of blades 22 radially arranged along the outer periphery of the hub 21. The pressure surface P1 of the blade 22 has the first pressure surface 31 extending from the hub 21 side at an angle of 90 degrees or less with respect to the forward direction of the rotation direction A, and the second pressure surface 32 extending from the first pressure surface 31 at an angle of more than 90 degrees with respect to the forward direction of the rotation direction A.

With this configuration, when the impeller 12 rotates, the first pressure surface 31 generates fluid flow moving along the hub 21 surface. At this time, a low-energy fluid B is prone to stagnate on a suction surface P2 side of the blade 22 in front. However, the second pressure surface 32 generates fluid flow going to the suction surface P2 side of the blade 22 in front, which reduces the low-energy fluid B stagnating on the suction surface P2 side of the blade 22. As a result, impeller efficiency improves.

In the impeller 12 according to the present embodiment, the pressure surface P1 of the blade 22 has the third pressure surface 33 extending from the second pressure surface 32 at an angle of 90 degrees or less with respect to the forward direction of the rotation direction A. The third pressure surface 33 generates fluid flow going to the suction surface P2 side of the blade 22 in front, which reduces the low-energy fluid B stagnating on the suction surface P2 side of the blade 22.

In the impeller 12 according to the present embodiment, the first pressure surface 31 and the third pressure surface 33 are slanted with respect to the hub 21, inclining forward in the rotation direction A. With this configuration, the first pressure surface 31 and the third pressure surface 33 generate fluid flows, which act to reduce the low-energy fluid B stagnating on the hub 21 side of the suction surface P2 side of the blade 22 in front.

In the impeller 12 according to the present embodiment, the pressure surface P1 of the blade 22 has the second pressure surface 32 at least on the outer peripheral side of the blade 22. The low-energy fluid B stagnating on the suction surface P2 side of the blade 22 in front tends to be generated on the trailing edge 22*b* side of the blade 22. With the second pressure surface 32 located on the trailing edge 22*b* side of the blade 22, the low-energy fluid B stagnating on the suction surface P2 side of the blade 22 is effectively reduced.

In the impeller 12 according to the present embodiment, the pressure surface P1 of the blade 22 has a curved shape on the leading edge 22*a* side (the inner peripheral side), bending forward in the rotation direction A, while having an S-shape on the trailing edge 22*b* side (the outer peripheral side), the S-shape being formed of the first pressure surface 31, the second pressure surface 32, and the third pressure surface 33. With the pressure surface P1 having a curved shape on the leading edge 22*a* side and an S-shape on the trailing edge 22*b* side, a fluid is pressure-fed efficiently.

In the impeller 12 according to the present embodiment, the second pressure surface 32 is located within one-half (½) or less the length of the blade 22 from the hub 21 in a direction along the rotation axis. With this configuration, the second pressure surface 32 is located on the hub 21 side of the blade 22. This effectively reduces the low-energy fluid B stagnating on the suction surface P2 side of the blade 22.

In the impeller 12 according to the present embodiment, the second pressure surface 32 faces the suction surface P2 in the distal end part 22*d* of the blade 22 located in front in the rotation direction A. With this configuration, fluid flow generated by the second pressure surface 32 flows to the opposing suction surface P2 in the distal end part 22*d* of the blade 22. This effectively reduces the low-energy fluid B stagnating on the suction surface P2 side of the blade 22.

The fluid machine according to the present embodiment includes the casing 11 having a hollow shape, the impeller 12 rotatably supported in the casing 11, the impeller having the plurality of blades 22 radially arranged along an outer peripheral surface of the hub 21 having an annular shape, the suction passage 13 through which a fluid flows along the direction of the axis of the impeller 12 to be drawn in the impeller 12, and the discharge passage 14 through which the fluid having been pressure-fed by the impeller 12 is discharged, flowing along the direction intersecting the direction of the axis of the impeller 12. The pressure surface P1 of the blade 22 has the first pressure surface 31 extending from the hub 21 side at an angle of 90 degrees or less with respect to the forward direction of the rotation direction A, and the second pressure surface 32 extending from the first pressure surface 31 at an angle of more than 90 degrees with respect to the forward direction of the rotation direction A.

With this configuration, when the impeller 12 rotates, the fluid is drawn in through the suction passage 13, flowing along the direction of the axis of the impeller 12. Subsequently, the fluid having been compressed by the impeller 12 is discharged from the discharge passage 14, flowing along the direction intersecting the direction of the axis of the impeller 12. At the same time, in the impeller 12, the first pressure surface 31 generates fluid flow moving along the hub 21 surface, when a low-energy fluid B is prone to stagnate on the suction surface P2 side of the blade 22 in front. However, the second pressure surface 32 generates fluid flow going to the suction surface P2 side of the blade 22 in front, which reduces the low-energy fluid B stagnating on the suction surface P2 side of the blade 22. As a result, impeller efficiency improves.

In an impeller and a fluid machine according to the present invention, there is provided a second pressure surface on a pressure surface of a blade, the second pressure surface extending at an angle more than 90 degrees with respect to the forward direction of the rotation direction. This does not mean a first pressure surface and a third pressure surface are limited in form.

In the foregoing embodiment, the impeller 12 has the plurality of blades 22 fixed circumferentially at predetermined intervals on the outer peripheral surface of the hub 21. The impeller 12 is a so-called open impeller with a specified space between the impeller 12 and the shroud 23 of the casing 11. However, the configuration of the impeller 12 is not limited to that of the embodiment. The invention can be applied to a so-called closed impeller which has, in addition to a plurality of blades fixed circumferentially at predetermined intervals on the outer peripheral surface of a hub, a ring-shaped shroud fixed on the outer side of each of the blades.

REFERENCE SIGN LIST

10 centrifugal compressor (fluid machine)
11 casing
12 impeller
13 suction passage
14 discharge passage
15 rotary shaft
21 hub
22 blade
23, 24 shroud
31 first pressure surface
32 second pressure surface
33 third pressure surface
A rotation direction
B low-energy fluid
P1 pressure surface
P2 suction surface

The invention claimed is:

1. An impeller comprising:

a hub having an annular shape; and a plurality of blades radially arranged along an outer peripheral surface of the hub, the impeller being configured in such a manner that a fluid having flowed from a leading edge side of the blade along a rotation axis is discharged from a trailing edge side of the blade outward in the radial direction intersecting the rotation axis, wherein a pressure surface of the blade includes:

a first pressure surface extending from the hub side at an angle of 90 degrees or less with respect to a forward direction of a direction of rotation of the impeller;

a second pressure surface extending from the first pressure surface at an angle of more than 90 degrees with respect to the forward direction of the direction of rotation of the impeller; and a third pressure surface extending from the second pressure surface at an angle of 90 degrees or less with respect to the forward direction of the direction of rotation of the impeller, and the pressure surface of the blade has a curved shape bending forward in the rotation direction on an inner peripheral side, while having an S-shape formed of the first pressure surface, the second pressure surface, and the third pressure surface on an outer peripheral side.

2. The impeller according to claim 1, wherein the first pressure surface and the third pressure surface are inclined forward in the rotation direction with respect to the hub.

3. The impeller according to claim 1, wherein the pressure surface of the blade includes the second pressure surface at least on an outer peripheral side of the blade.

4. The impeller according to claim 1, wherein the second pressure surface is located within one-half (½) or less the length of the blade from the hub in a direction along the rotation axis.

5. The impeller according to claim 1, wherein the second pressure surface faces a suction surface in a distal end part of the blade located in front in the rotation direction.

6. A fluid machine comprising:

a casing having a hollow shape;

an impeller rotatably supported in the casing, and having a plurality of blades radially arranged along an outer peripheral surface of a hub having an annular shape;

a suction passage through which a fluid flows along a direction of an axis to be drawn in the impeller from a leading edge side of the impeller; and a discharge passage through which the fluid having been pressure fed by the impeller flows to be discharged from a trailing edge side of the blade outward in the radial direction intersecting the direction of an axis of the impeller, wherein a pressure surface of the blade includes:

a first pressure surface extending from the hub side at an angle of 90 degrees or less with respect to a forward direction of a direction of rotation of the impeller;

a second pressure surface extending from the first pressure surface at an angle of more than 90 degrees with respect to the forward direction of the direction of rotation of the impeller; and a third pressure surface extending from the second pressure surface at an angle of 90 degrees or less with respect to the forward direction of the direction of rotation of the impeller, and the pressure surface of the blade has a curved shape bending forward in the rotation direction on an inner peripheral side, while having an S-shape formed of the first pressure surface, the second pressure surface, and the third pressure surface on an outer peripheral side.

* * * * *